United States Patent [19]

Lossa

[11] Patent Number: 4,542,618

[45] Date of Patent: Sep. 24, 1985

[54] THREAD PULL-OFF AID OF VARIABLE GEOMETRICAL CONFIGURATION FOR THE OVERHEAD DRAWING-OFF OF A THREAD FROM A CREEL BOBBIN

[75] Inventor: Ulrich Lossa, Krefeld, Fed. Rep. of Germany

[73] Assignee: Palitex Project-Company GmbH, Krefeld, Del.X

[21] Appl. No.: 592,230

[22] Filed: Mar. 22, 1984

[30] Foreign Application Priority Data

Mar. 23, 1983 [DE] Fed. Rep. of Germany ..... 3310438

[51] Int. Cl.[4] ..... D01H 13/10; D01H 13/24; B65H 49/00

[52] U.S. Cl. ..... 57/58.83; 242/128

[58] Field of Search ..... 57/58.49, 58.7, 58.72, 57/58.83, 58.86; 242/154, 128, 129.5

[56] References Cited

U.S. PATENT DOCUMENTS

| | | | |
|---|---|---|---|
| 2,732,142 | 1/1956 | Grein | 242/154 X |
| 2,956,756 | 10/1960 | Halkyard | 242/154 X |
| 3,284,024 | 11/1966 | Franzen | 242/128 |
| 3,323,299 | 6/1967 | Heimes | 57/58.83 |
| 3,950,927 | 4/1976 | Kallman | 57/58.83 X |
| 4,017,037 | 4/1977 | Kovaleski | 242/128 X |
| 4,078,371 | 3/1978 | Hatcher et al. | 57/58.86 |
| 4,439,979 | 4/1984 | Winkelmann | 242/128 X |

*Primary Examiner*—Donald Watkins

*Attorney, Agent, or Firm*—Bell, Seltzer, Park & Gibson

[57] ABSTRACT

A pull-off aid of variable geometrical configuration for the overhead drawing-off of a thread (a,a') to be would onto a bobbin (1) from a feed or creel bobbin (11) mounted on a bobbin carrier, has an outer diameter which is variable by a control pulse which is dependent upon the increasing diameter of the bobbin (1) being wound and thereby upon the decreasing diameter of the feed or creel bobbin from which the thread is being drawn. To this end, a diameter sensor (2), by which the control pulse is initiated, responds when the bobbin being wound has reached a predetermined diameter.

8 Claims, 3 Drawing Figures

THREAD PULL-OFF AID OF VARIABLE GEOMETRICAL CONFIGURATION FOR THE OVERHEAD DRAWING-OFF OF A THREAD FROM A CREEL BOBBIN

BACKGROUND AND OBJECTIVES OF THE INVENTION

This invention relates to a thread pull-off aid of variable geometrical configuration for the overhead drawing-off of a thread from a feed or creel bobbin which is mounted on a bobbin carrier, the geometrical configuration of the pull-off aid being variable by a control pulse which is dependent directly or indirectly upon the decreasing diameter of the creel bobbin.

In the case of a disc-shaped pull-off aid of this kind in which is described in German Patent Specification No. 30 29 598, corresponding to U.S. Pat. No. 4,502,644, and whose disc comprises segments which are radially displaceable with respect to its diameter, the weight or the diameter of the feed or creel bobbin, or alternatively, the elapsed time during which pull-off from the bobbin has taken place, is used as a control variable or, alternatively, as a control pulse for the radial displacement.

The present invention resides in a pull-off aid of variable geometrical configuration for the overhead drawing-off of a thread, to be wound onto a bobbin, from a feed or creel bobbin mounted on a bobbin carrier, the pull-off aid having a geometrical configuration which is variable by a control pulse and a diameter sensor being provided for sensing the diameter of the bobbin being wound to produce the said control pulse when the bobbin being wound has a predetermined diameter, whereby the configuration of the pull-off aid is dependent on the diameter of the feed or creel bobbin.

If considerations are based on the fact that, with respect to its state, the variable pull-off aid is to be varied to a new, smaller diameter when the feed or creel bobbins are approximately at half their diameter, the same applies to the bobbin being wound, since the latter will at the same instant have reached a specific precalculable diameter. Hence, the bobbin being wound has an associated diameter sensor by which the control pulse varying the pull-off aid is triggered when the bobbin being wound reaches a predetermined diameter.

BACKGROUND AND OBJECTIVES OF THE INVENTION

This invention relates to a thread pull-off aid of variable geometrical configuration for the overhead drawing-off of a thread from a feed or creel bobbin which is mounted on a bobbin carrier, the geometrical configuration of the pull-off aid being variable by a control pulse which is dependent directly or indirectly upon the decreasing diameter of the creel bobbin.

In the case of a disc-shaped pull-off aid of this kind in which is described in German Patent Specification No. 30 29 598, and whose disc comprises segments which are radially displaceable with respect to its diameter, the weight or the diameter of the feed or creel bobbin, or alternatively, the elapsed time during which pull-off from the bobbin has taken place, is used as a control variable or, alternatively, as a control pulse for the radial displacement.

The present invention resides in a pull-off aid of variable geometrical configuration for the overhead drawing-off of a thread, to be wound onto a bobbin, from a feed or creel bobbin mounted on a bobbin carrier, the pull-off aid having a geometrical configuration which is variable by a control pulse and a diameter sensor being provided for sensing the diameter of the bobbin being wound to produce the said control pulse when the bobbin being wound has a predetermined diameter, whereby the configuration of the pull-off aid is dependent on the diameter of the feed or creel bobbin.

If considerations are based on the fact that, with respect to its state, the variable pull-off aid is to be varied to a new, smaller diameter when the feed or creel bobbins are approximately at half their diameter, the same applies to the bobbin being wound, since the latter will at the same instant have reached a specific precalculable diameter. Hence, the bobbin being wound has an associated diameter sensor by which the control pulse varying the pull-off aid is triggered when the bobbin being wound reaches a predetermined diameter.

In the case of a two-for-one twisting spindle, the control pulse would come from, for example, the cross-wound bobbin. This control pulse is transmitted to the spindle and has to be conducted across the air gap between an outer ballooning limiter and the inner wall of a protective pot. This can be done by electro-magnetic or pneumatic means and possibly also by optical means. A combination of electro-magnets and permanent magnets are provided in a preferred embodiment.

Alternatively, in the case of transmission of power into the spindle by a gaseous medium (compressed air), a device in the form of, for example, a compressed-air nozzle can be chosen and is located in the outer region of the spindle approximately on a level with the pull-off aid. When the balloon of yarn is running, a jet of air can be directed through an opening in the balloon limiter. A further opening in the wall of the protective pot is aimed at a point which is located in the disc by which, for example, a pre-stressed or cocked device is triggered to then vary the state of the pull-off aid, such as changing the circumference of the disc to a smaller diameter.

The pull-off aid in accordance with the invention is suitable both for the taking-off of the thread from only one feed bobbin and for the taking-off of the thread from two or more feed bobbins mounted one above the other on a bobbin carrier or the like.

DETAILED DESCRIPTION OF PREFERRED EMBODIMENT

Figure 1:
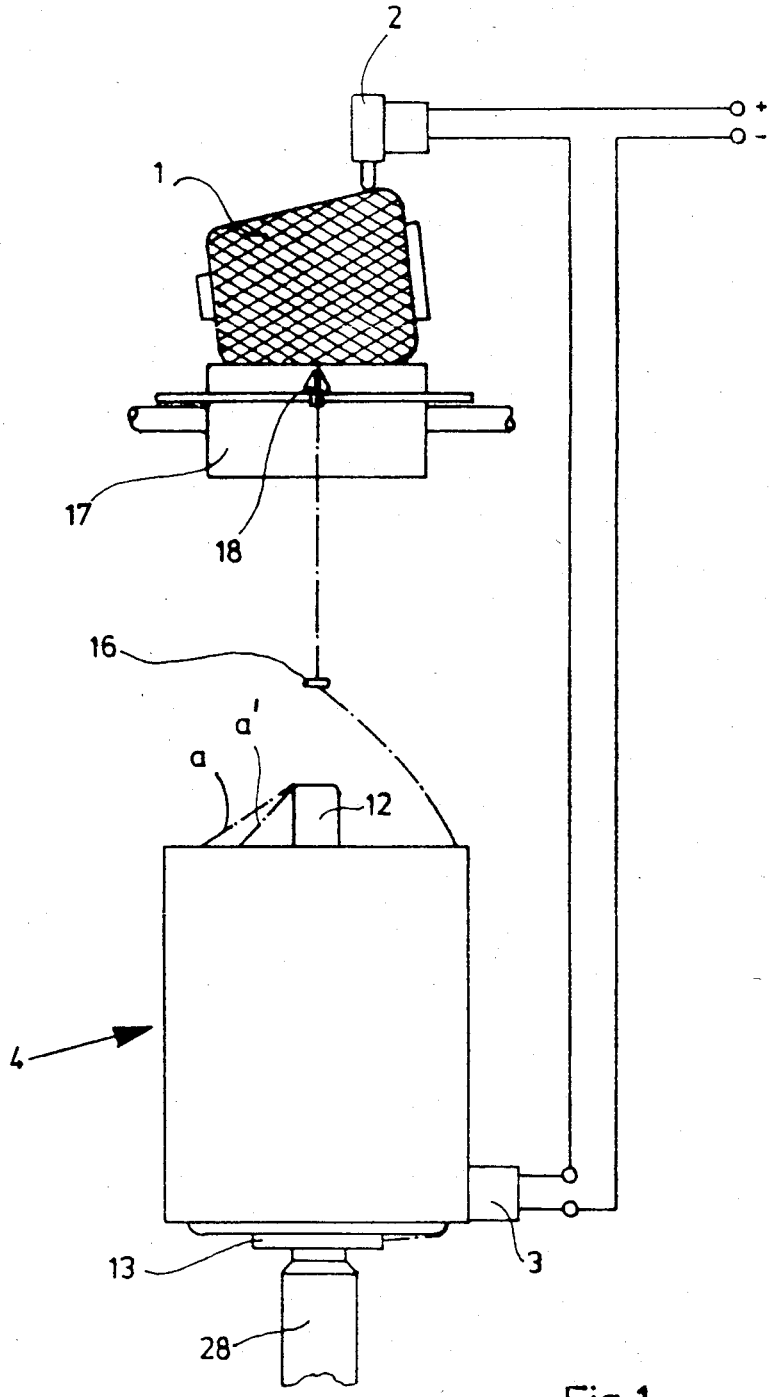
FIG. 1 is a diagrammatic illustration of a two-for-one twisting spindle having a winding unit and an associated sensor for controlling the diameter of a pull-off aid disc.

A possible field of application of the thread pull-off aid in accordance with the invention is illustrated diagrammatically in FIG. 1 which shows a two-for-one twisting spindle 4 in which threads a and a′ are drawn from two feed bobbins 11 and 11′ (FIG. 2) and, after passing through the hollow axle 12 of the twisting spindle and leaving the thread storage disc 13, are guided upwardly through the annular gap located between a bobbin protection pot 14 and a ballooning limiter 15 to a central thread-guide eyelet 16 and are commonly wound onto a winding bobbin 1. In addition to the bobbin 1 being wound, the winding unit includes a friction drive roller 17 which drives the bobbin 1, and a traversing thread-guide 18.

The bobbin 1 being wound has an associated diameter sensor 2 which is electrically connected to a control device 3 to which the sensor 2 feeds control pulses either continuously, or preferably intermittently, in dependence upon the varying, that is to say, increasing, diameter of the bobbin 1 being wound.

Figure 2:
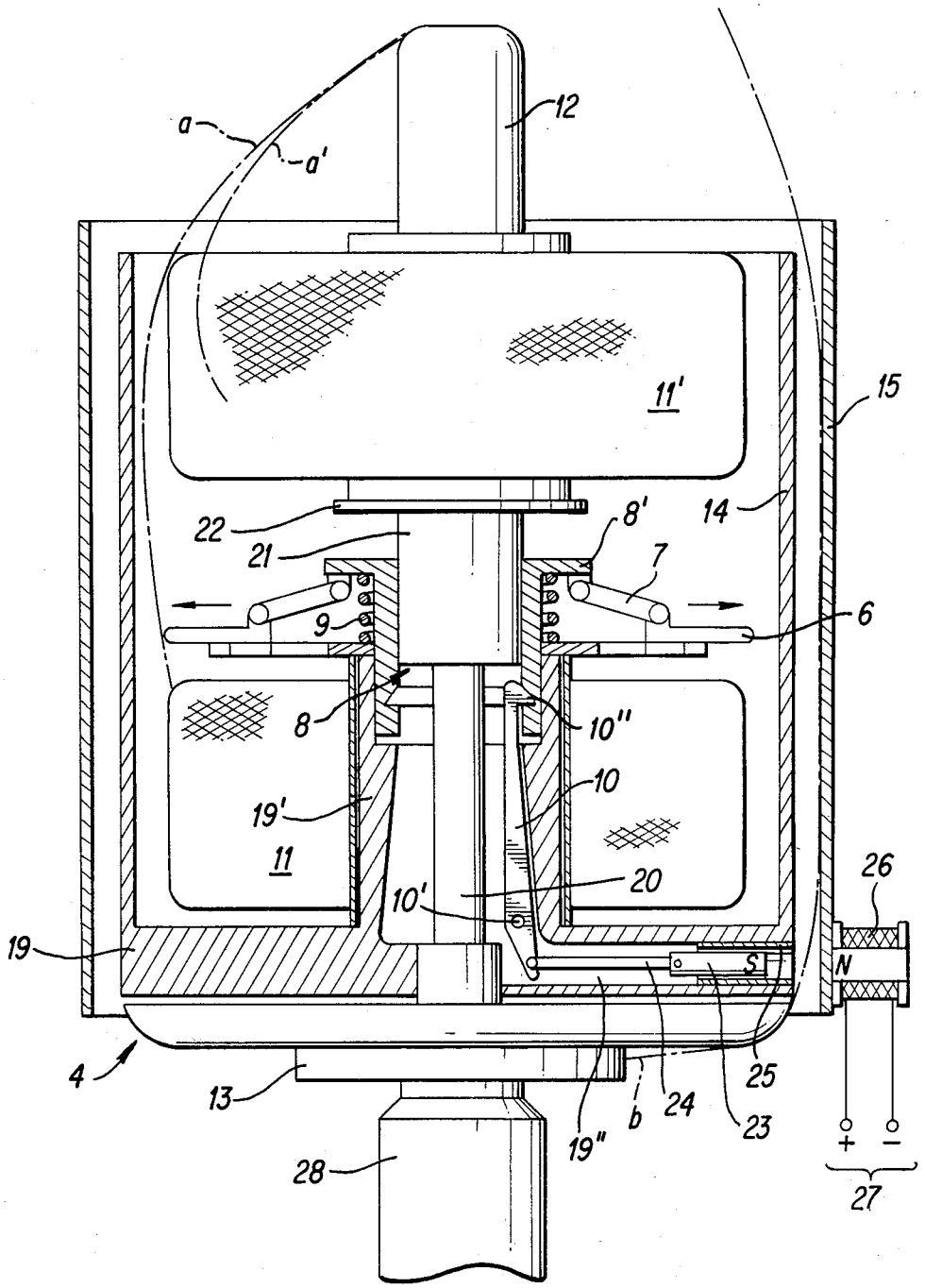
FIG. 2 is a diagrammatic sectional view of a two-for-one twisting spindle with two bobbins disposed one above the other and a pull-off aid disc assuming first position.
Figure 3:
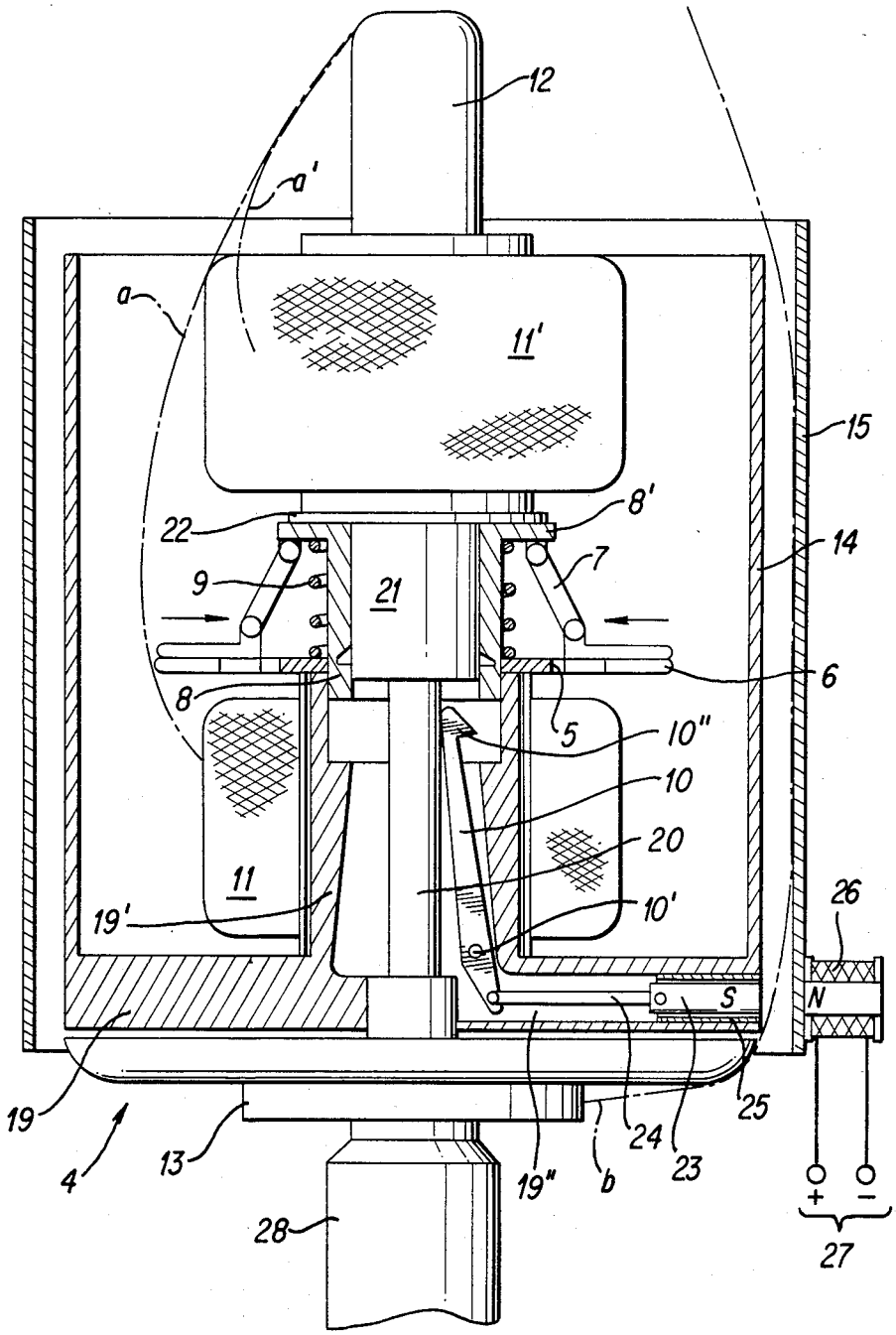
FIG. 3 is an illustration corresponding to that of FIG. 2, in which the pull-off aid disc has assumed a second position with with reduced diameter.

Referring to FIGS. 2 and 3, the bottom 19 of the protective pot 14 of the two-for-one twisting spindle 4 is provided with a central hub member 19' onto which is slipped the lower feed or creel bobbin 11 supported on the bottom 19 of the protective pot 14.

A guide tube 20, forming the hollow axle 12 of the twisting spindle 4 extends within the hub 19' and, substantially in the region of the upper edge of the hub 19' of the protective pot 14, merges into a cylindrical housing 21 which carries a support flange 22. Further working units (not shown), such as a thread brake or the like, may be located in the cylindrical housing.

The threads a and a' drawn separately from the two feed bobbins 11 and 11' are guided to the top end of the thread inlet end of the hollow axle 12 and are deflected downwardly to the thread storage disc 13 and, after further deflection in a radial direction, they leave the thread storage disc 13 as a combined twisted thread b which is guided upwardly to the thread-guide eyelet 16 and to the bobbin 1 being wound through the gap between the wall of the protective pot 14 and the wall of the ballooning limiter 15.

A support disc 5 of the pull-off aid disc, in accordance with the invention, is supported on the top edge of the hub 19' of the protective pot 14 and, for the purpose of varying the diameter of the disc 5, comprises a plurality of disc segments 6 which partially overlap one another and which are displaceable in a radial direction. The disc segments 6 are guided in radial slots in the support disc 5 and, when in the state illustrated in FIG. 2, their outer edges commonly form a circular disc which forms a pull-off aid for the thread a drawn from the lower bobbin 11.

FIG. 2 shows the state in which the pull-off aid disc 5, 6 has its larger diameter. A sliding sleeve 8 is guided on the cylindrical housing 21 and has an upper annular flange 8'. Guide links 7 are articulated at one end to the underside of the annular flange 8' by means of pivots, while the other ends of the guide links 7 are articulated to the inner edges of the disc segments 6. A helical compression spring 9 is supported between the annular disc 5 and the annular flange 8' and exerts an upwardly directed force on the annular flange 8'. In order to hold the annular flange 8' in its lower position illustrated in FIG. 2, and which corresponds to the largest diameter of the pull-off aid disc 5, 6, when the creel bobbin 11 is fully wound or is still substantially fully wound, a mechanical retaining member in the form of a double-arm lever 10 pivotable about the spindle 10' is provided and, by means of a lug 10'' provided at its upper end, engages a circumferential groove in the interior of the sliding sleeve 8, by means of the pre-stressed spring 9, but may be released by an actuator which comprises an armature in the form of a permanent-magnetic plunger 23 which engages the bottom end of the lever 10 by way of a plunger rod 24. The permanent-magnetic plunger 23 is guided in a sleeve 25 which is fitted into a radial bore 19'' in the bottom 19 of the protective pot 14. An electromagnet 26 connectible to a current source 27 is associated with the permanent-magnetic plunger 23 and is located outside the ballooning limiter 15.

When the diameter sensor 2 detects or ascertains that the outer diameter of the bobbin 1 being wound has reached a predetermined value, a control variable or a control emanates from the sensor 2 and acts upon the solenoid of the electromagnet 26 such that the electromagnetic itself is magnetically polarized to attract the permanent-magnetic plunger 23, which is correspondingly polarized, radially outwardly, whereby the lug 10'' of the double-arm lever 10 is pivoted inwardly to release the sliding sleeve 8, so that the sliding sleeve 8, together with the annular flange 8', is displaced by the helical compression spring 9 into the upper position illustrated in FIG. 3. The disc segments 6 guided radially in the support disc 5 are drawn inwardly by the guide links 7 during the upward movement of the sliding sleeve 8 and the annular flange 8', whereby the external diameter of the pull-off aid discs 5, 6 is reduced to, for example, the external diameter of the support disc 5.

FIGS. 2 and 3 show a control arrangement which comprises an electromagnet 26 and a permanent magnet 23 in order to conduct a control "pulse" across the annular air gap between the inner wall of the outer ballooning limiter 15 and the outer wall of the inner protective pot 14 when the spindle is rotating and thus the balloon of thread is rotating.

In another embodiment of the invention in which the transmission of power or the transmission of the control pulse into the interior of the spindle 4 is effected by a gaseous medium, such as compressed air, an actuator can be used which is positioned in the outer region of the spindle and approximately on a level with the pull-off aid disc 5, 6. When the balloon of thread is rotating, a jet of air can be directed through an opening (not illustrated) in the ballooning limiter 15 and through a further opening in the wall of the protective pot 14 onto a point which is located in the region of the pull-off aid disc 5, 6 and from which a pre-stressed (cocked) device is triggered, thereupon to reduce the circumference of the disc to a smaller diameter.

In a further embodiment of the invention, stopping of the spindle itself can be achieved in a very simple manner. In this connection, the control pulse emanating from the diameter sensor 2 is conducted directly to the spindle brake in order to brake the rotating parts of the spindle momentarily, the spindle of the spindle wharve 28 remaining on the drive belt (not illustrated). In this case, the winding process must also be interrupted simultaneously by, for example, stopping the friction drive roller 17. Compressed air can now be fed to the spindle 4 through, for example, a compressed-air passage which extends through the bottom of the protective pot 14 and to which a nozzle insertable through an opening in the ballooning limiter 15 can be connected. The compressed air is used to actuate a latch or the like, for example, in the form of a double-arm lever 10, located in the interior of the spindle, so that the pull-off aid disc 5, 6 is reduced to its smaller diameter.

After this task has been performed, the spindle and the running-on of the thread can be started again and the twisting process can be continued without breakage of the thread.

In yet another embodiment, provision is made for the actuator for varying the diameter of the pull-off aid to be operated optically.

I claim:

1. A thread pull-off aid mechanism for use in a thread processing machine, in which thread is drawn overhead from at least one feed bobbin to be wound onto a winding bobbin, to prevent the thread being pulled off the feed bobbin from rubbing against or interfering with the outer windings of thread remaining on the feed bobbin, said thread pull-off aid mechanism comprising:

means of variable geometrical configuration adapted to be positioned in the thread processing machine at a position for contacting and guiding the thread being pulled off the feed bobbin away from the outer windings of thread remaining on the feed bobbin and for varying its geometrical configuration in relation to the diameter of the feed bobbin; and means associated with said thread contacting and guide means for controlling the variation of the geometrical configuration thereof including means for sensing the diameter of the winding bobbin, which increases as the diameter of the feed bobbin decreases, and for producing a control signal.

2. A spindle assembly of two-for-one twister thread processing machine having means for carrying at least one feed bobbin of thread, means for drawing off the thread overhead from the feed bobbin, and means for winding the processed thread on a winding bobbin; the combination therewith of a thread pull-off aid mechanism for preventing the thread being pulled off the feed bobbin from rubbing against or interfering with the outer windings of thread remaining on the feed bobbin, said thread pull-off aid mechanism comprising:

means of variable geometrical configuration mounted in said spindle assembly of said thread processing machine at a position for contacting and guiding the thread being pulled off the feed bobbin away from the outer windings of thread remaining on the feed bobbin and for varying its geometrical configuration in relation to the diameter of the feed bobbin; and means associated with said thread contacting and guide means for controlling the variation of the geometrical configuration thereof including means for sensing the diameter of the winding bobbin, which increases as the diameter of the feed bobbin decreases, and for producing a control signal.

3. Apparatus, as set forth in claim 1 or 2, in which said control means includes means for producing a magnetic signal, and in which said thread contacting and guide means includes means responsive to the magnetic signal.

4. Apparatus, as set forth in claim 3, in which said means for producing a magnetic signal of said control means comprises an electromagnet, and said means responsive to the magnetic signal of said thread contacting and guide means comprises a permanent magnet.

5. Apparatus, as set forth in claim 1 or 2, in which said thread contacting and guide means includes a variable-diameter generally disc-shaped member, and a pre-stresses unit means for reducing the diameter of said disc-shaped member in response to the control signal from said winding bobbin diameter sensing and signal producing means of said control means.

6. Apparatus, as set forth in claim 5, in which said disc-shaped member comprises radially-displaceable segments; in which said pre-stressed unit means includes a sliding sleeve mounting said thread contacting and guide means in the thread processing machine, a helical compression spring biasing said sliding sleeve toward a first position, and a movable lever for locking said sliding sleeve in a second position against the bias of said spring and for being moved to release said sliding sleeve; and in which said thread pull-off aid mechanism further includes link means connected between said radially-displaceable segments of said disc-shaped member and said sliding sleeve of said pre-stressed unit means for moving said radially-displaceable segments and varying the diameter of disc-shaped member in relation to the position of said sliding sleeve.

7. Apparatus, as set forth in claim 6, in which said control means includes means for producing a magnetic signal, and in which said thread contacting and guide means includes means connected to said lever means of said pre-stressed unit and responsive to the magnetic signal for releasing said lever means.

8. Apparatus, as set forth in claim 7, in which said means for producing a magnetic signal of said control means comprises an electromagnetic, and said means responsive to the magnetic signal for releasing said lever means comprises a permanent magnet plunger movable in response to the magnetic signal of said electromagnet and connected to said lever means.

* * * * *

UNITED STATES PATENT AND TRADEMARK OFFICE

CERTIFICATE OF CORRECTION

PATENT NO. : 4,542,618

DATED : September 24, 1985

INVENTOR(S) : Ulrich Lossa

It is certified that error appears in the above-identified patent and that said Letters Patent are hereby corrected as shown below:

In the Abstract, line 2, "would" should be -- wound --.

Column 4, line 8, after the word "control" insert the word -- pulse --.

Column 4, line 10, "magnetic" should be -- magnet --.

Column 6, line 15, "stresses" should be -- stressed --.

Column 6, line 25, after the word "lever" insert the word -- means --.

Column 6, line 43, "electromagnetic" should be -- electromagnet --.

Signed and Sealed this

*Twenty-fourth* Day of *December 1985*

[SEAL]

*Attest:*

DONALD J. QUIGG

*Attesting Officer*

*Commissioner of Patents and Trademarks*